US008425184B2

(12) United States Patent
Druez et al.

(10) Patent No.: US 8,425,184 B2
(45) Date of Patent: Apr. 23, 2013

(54) TURBINE SHROUD RING WITH ROTATION PROOFING RECESS

(75) Inventors: Bruno Druez, Melun (FR); Thomas Langevin, Brunoy (FR); Sebastien Jean Laurent Prestel, Arpajon (FR); Guillaume Sevi, Ivry sur Seine (FR)

(73) Assignee: Snecma, Paris (FR)

( * ) Notice: Subject to any disclaimer, the term of this patent is extended or adjusted under 35 U.S.C. 154(b) by 880 days.

(21) Appl. No.: 12/695,664

(22) Filed: Jan. 28, 2010

(65) Prior Publication Data

US 2010/0284811 A1 Nov. 11, 2010

(30) Foreign Application Priority Data

Jan. 28, 2009 (FR) ..... 09 50502

(51) Int. Cl.
*F01D 9/04* (2006.01)
*F01D 11/08* (2006.01)

(52) U.S. Cl.
USPC ..... 415/173.1; 415/173.4; 415/173.5; 415/209.1; 415/209.2; 415/209.3

(58) Field of Classification Search ..... 415/173.1, 415/173.4, 173.5, 209.1, 209.2, 209.3
See application file for complete search history.

(56) References Cited

U.S. PATENT DOCUMENTS 4,676,715 A * 6/1987 Imbault et al. ..... 415/173.4
4,687,413 A * 8/1987 Prario ..... 415/190
5,018,941 A * 5/1991 Heurtel et al. ..... 416/220 R
5,205,708 A * 4/1993 Plemmons et al. ..... 415/173.1
5,775,874 A * 7/1998 Boite et al. ..... 415/209.3
6,575,697 B1 * 6/2003 Arilla et al. ..... 415/173.1
6,699,011 B2 * 3/2004 Cot et al. ..... 415/173.1

FOREIGN PATENT DOCUMENTS

EP 1 225 309 A1 7/2002
GB 2 309 053 A 7/1997

OTHER PUBLICATIONS

U.S. Appl. No. 12/994,785, filed Nov. 26, 2010, Bonneau et al.
Pauli Pedersen, "Suggested Benchmarks for Shape Optimization for Minimum Stress Concentration", Structural and Multidisciplinary Optimization, Springer, vol. 35, No. 4, XP019583504, Jul. 18, 2007, pp. 273-282.

* cited by examiner

*Primary Examiner* — Igor Kershteyn
(74) *Attorney, Agent, or Firm* — Oblon, Spivak, McClelland, Maier & Neustadt, L.L.P.

(57) ABSTRACT

A turbine shroud ring sector for a turbomachine supported at the upstream end by a downstream support of a turbine casing with circular sliding including a first stop able to collaborate with a second stop borne by an element of the turbomachine adjacent to the shroud ring in order to immobilize the shroud ring circularly is disclosed. The sector includes, on an end facing the element, a recess able to allow the second stop to pass to come into contact with the first stop. The recess is cut substantially in the form of a rectangle having, at the bottom of the recess, corners that are rounded in a circular arc of radius r. The bottom of the recess has a convex shape tangential to the circular arcs of the rounded corners and with a curvature that evolves between a radius of curvature r where it meets the rounded corners and a radius of R, greater than the radius r, at a point situated between the two rounded corners.

14 Claims, 3 Drawing Sheets

TURBINE SHROUD RING WITH ROTATION PROOFING RECESS

BACKGROUND OF THE INVENTION

The field of the present invention is that of aeronautical engines, particularly that of turbomachines.

Aeronautical turbomachines conventionally comprise several modules such as a low-pressure (LP) compressor followed by a high-pressure (HP) compressor, a combustion chamber, a high-pressure turbine followed by a low-pressure turbine, each of which drives the corresponding LP or HP compressor, and a gas ejection device. Each of the turbines is formed alternately of wheels with fixed blades, or guide vanes, and of wheels of moving blades, which together form a turbine stage. The LP turbine modules may comprise several stages, of which there are usually two.

In the remainder of the description, mention of upstream and downstream is to be understood with reference to the direction in which the gases flow through the turbomachine.

The moving blades are carried at their lower part by the rotor of the turbomachine and are fixed to a turbine disk. The guide vane blades are produced in the form of adjacent blade sectors, supported by their upper part and fixed to a casing known as the turbine casing. The moving blades are generally positioned facing an abradable material borne by a circular component fixed to the casing and known as the turbine shroud ring. Small thin ribs borne by the root of the blade, and known as wipers, penetrate this abradable material to ensure sealing between the upstream and downstream sides of the blade, in spite of the deformations resulting from vibration and differing expansions of the various materials.

The turbine shroud rings of the LP stages are produced in the form of several sectors which are each mounted on a rib of the turbine casing, as indicated for example in document FR 96 00241 in the name of the Applicant company, and held in rotation, generally by collaboration between a first stop borne by the shroud ring and a second stop borne either by the guide vane blade sector situated upstream of this sector of the shroud ring or by the casing. In order for the guide vane or casing stop to be able to reach the shroud ring stop, a cutout or recess is made in the shroud ring, and the guide vane or casing stop extends through this cutout or recess.

DESCRIPTION OF THE PRIOR ART

In the prior art, this recess takes the form of a cylinder with radial generatrices, of rectangular cross section, the rectangle being open on one side opening toward the guide vane and on the opposite side having rounded corners and a flat bottom. The turbine shroud ring is subjected, during the course of its life, to a succession of heating and cooling sequences, with the heated sector deforming and becoming flatter each time it is heated. Each sector of the shroud ring is therefore subjected to a cycle of stressing which, in the prior art, causes cracks to appear in the region where the rounded corners meet the bottom of the recess. In the known way, it is possible to reduce the level of these stresses by increasing the radius of curvature of these corners, but this technique very soon reaches its limits because of the limited width of the part of the shroud ring in which this recess is cut.

SUMMARY OF THE INVENTION

It is an object of the present invention to alleviate these disadvantages by proposing a turbine shroud ring with a recess that does not have some of the disadvantages of the prior art and which, in particular, enjoys improved durability.

To this end, the subject of the invention is a turbine shroud ring sector for a turbomachine intended to be supported at the upstream end by a downstream support of a turbine casing with circular sliding, comprising a first stop able to collaborate with a second stop borne by an element of said turbomachine adjacent to said shroud ring in order to immobilize it circularly, said sector comprising, on an end facing said element, a recess able to allow said second stop to pass to come into contact with said first stop, said recess being cut substantially in the form of a rectangle having, at the bottom of the recess, corners that are rounded in a circular arc of radius r, wherein the bottom of the recess has a convex shape tangential to the circular arcs of the rounded corners and with a curvature that evolves between a radius of curvature r where it meets the rounded corners and a radius of R, greater than the radius r, at a point situated between the two rounded corners.

Switching from a recess bottom in the shape of a rectangle to a bottom in the shape of a basket handle makes it possible to achieve a very appreciable reduction in the level of stresses observed during operation in the region where the rounded corners meet the bottom of the recess.

For preference, the bottom of said recess has at least one circular arc portion of radius R. Alternatively, the bottom of said recess has at least two circular arcs tangential to one another, with radii R1 and R2, both greater than r, R2 being greater than R1, and the circular arc of radius R1 being tangential to the circular arc of radius r of one of the rounded corners.

The improvement consists in pushing the tangent to the point where the corners meet the bottom of the recess as far as possible toward the downstream end of the shroud ring in order to avoid excessively low curvatures which could act as crack initiators.

In one particular embodiment, the bottom of said recess has the shape of two helixes each having a tangent in common with one of the circular arcs of the rounded corners, and the curvature of which varies continuously from the radius r to the radius R.

This configuration constitutes a special version of the previous configuration, with a multiplicity of circular arcs the radii of which are in a constant progression.

For preference, the radius R is greater than the radius r by a factor of at least 5. More preferably still, the radius R is greater than the radius r by a factor of at least 10.

These factors guarantee low operating stresses and a corresponding lack of crack propagation.

The invention also relates to a turbine module for a turbomachine comprising at least one turbine shroud ring sector as described hereinabove and to a turbomachine comprising such a turbine module.

BRIEF DESCRIPTION OF THE DRAWINGS

The invention will be better understood, and other objects, details, features and advantages thereof will become more clearly apparent in the course of the following detailed explanatory description of one embodiment of the invention which is given purely by way of nonlimiting illustration with reference to the attached schematic drawings.

In these drawings.

DESCRIPTION OF THE PREFERRED EMBODIMENT

Figure 1:
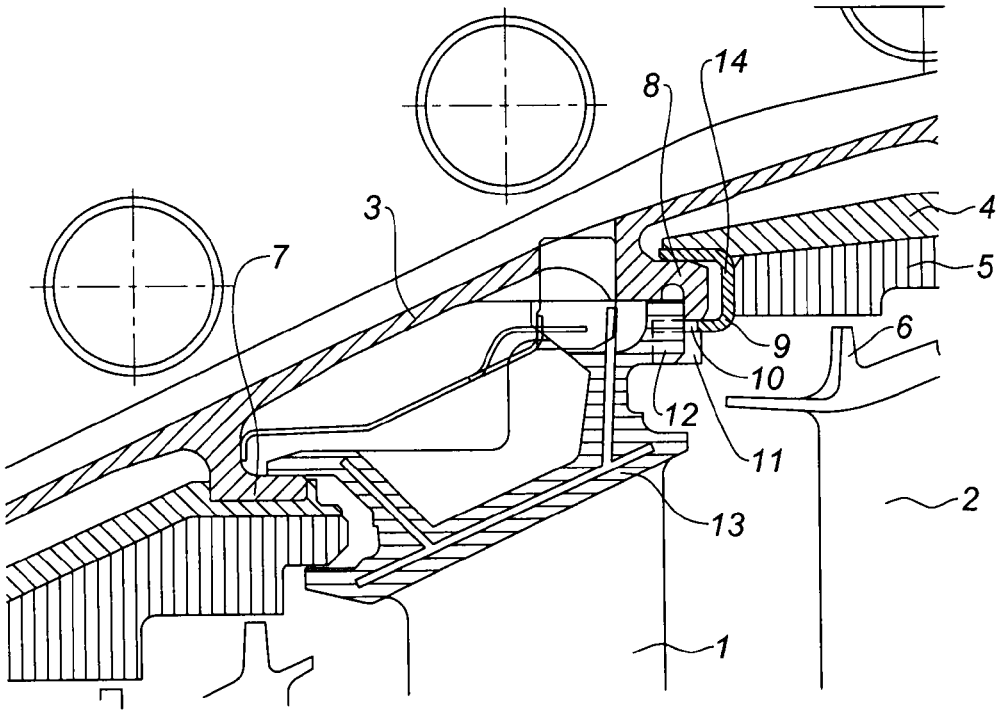
FIG. 1 is a view in radial section of a second stage of an LP turbine, with one guide vane blade and one shroud ring which are prevented from rotating by a set of stops.

Reference is made to FIG. 1 which is a cross section through the outer circumference of an LP turbine second stage comprising a guide vane blade, or fixed blade 1, upstream of a moving blade 2 (the upstream end being to the left in the figure), the two blades both being contained within a turbine casing 3. The moving blade 2 is positioned facing a turbine shroud ring 4, which bears an abradable material 5, into which the wipers 6 borne by the moving blade 2 can penetrate to ensure longitudinal sealing between the upstream and downstream sides of the blade in the gas flow path.

The root 13 of the guide vane blade 1 is supported, on the upstream side, by an upstream hook-shaped rib 7 extending axially from the casing 3, and on the downstream side by a support 9 formed in the turbine shroud ring 4. The turbine shroud ring 4 has, on the upstream side, an extension in the form of a slot 14, the upper part of the slot running axially to bear against a rib of the casing 3. This rib, which runs axially in the downstream direction of the guide vanes 1, in the form of a downstream hook or support 8, forms an upstream support for the turbine shroud ring. The lower part of the slot 14 forms the support 9 that supports the downstream part of the root 13 of the fixed blade 1.

Figure 2:
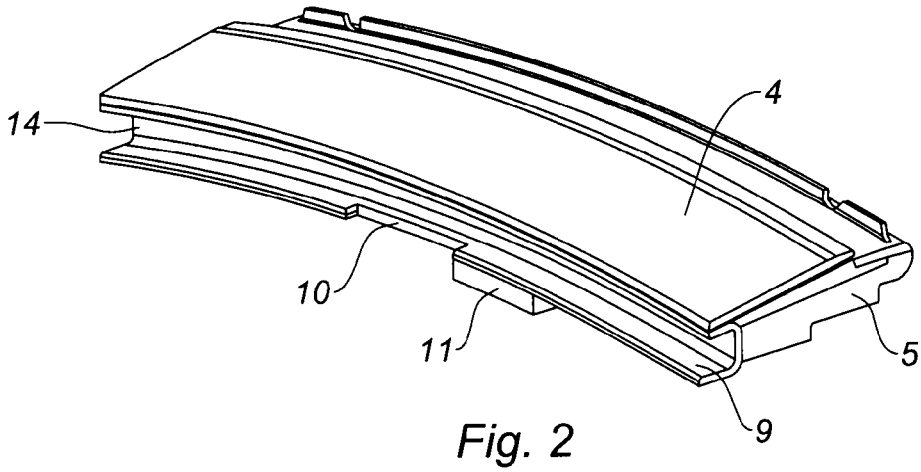
FIG. 2 is a perspective view of a turbine shroud ring sector comprising a recess according to one embodiment of the invention.

FIG. 2 shows a turbine shroud ring sector 4 with the layer of abradable material 5 situated at its lower part and its support 9 at the lower part of the slot 14, the purpose of which is to support the root 13 of an LP guide vane sector. Cut into the circumference of the support 9 is a recess 10 which is positioned next to a first circumferential stop 11 the function of which is to restrain the shroud ring in terms of rotation, without it the shroud ring being free to slide along the downstream hook 8 on which it is placed.

Figure 3:
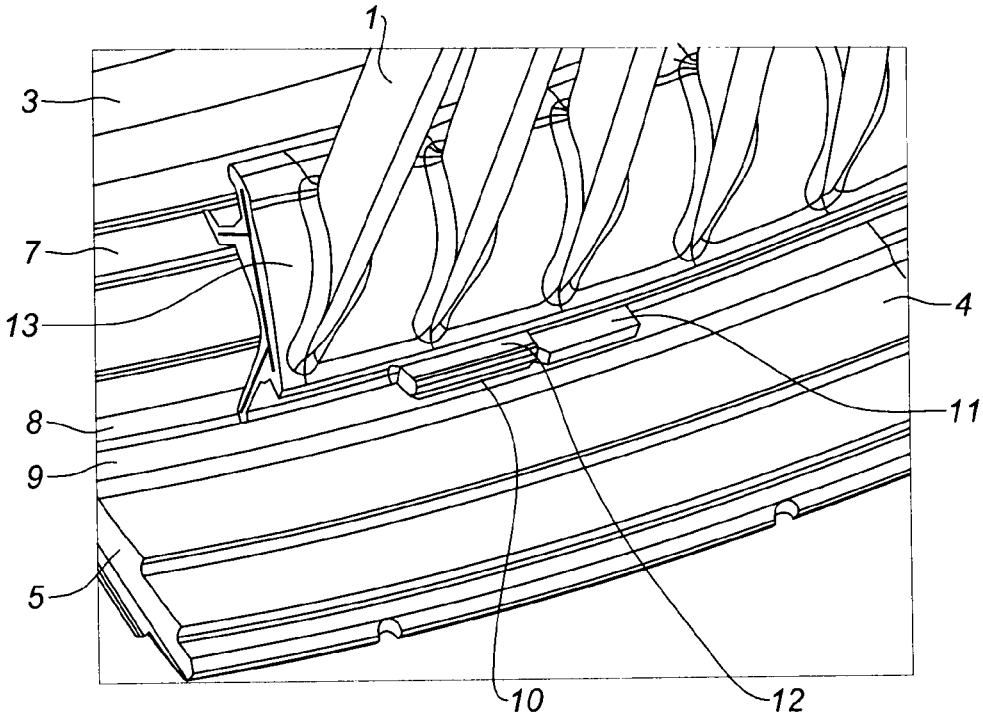
FIG. 3 is a perspective view of an LP turbine second stage guide vanes sector and of the corresponding turbine shroud ring, with the stop of the guide vanes in place in the recess of the shroud ring.
Figure 4:
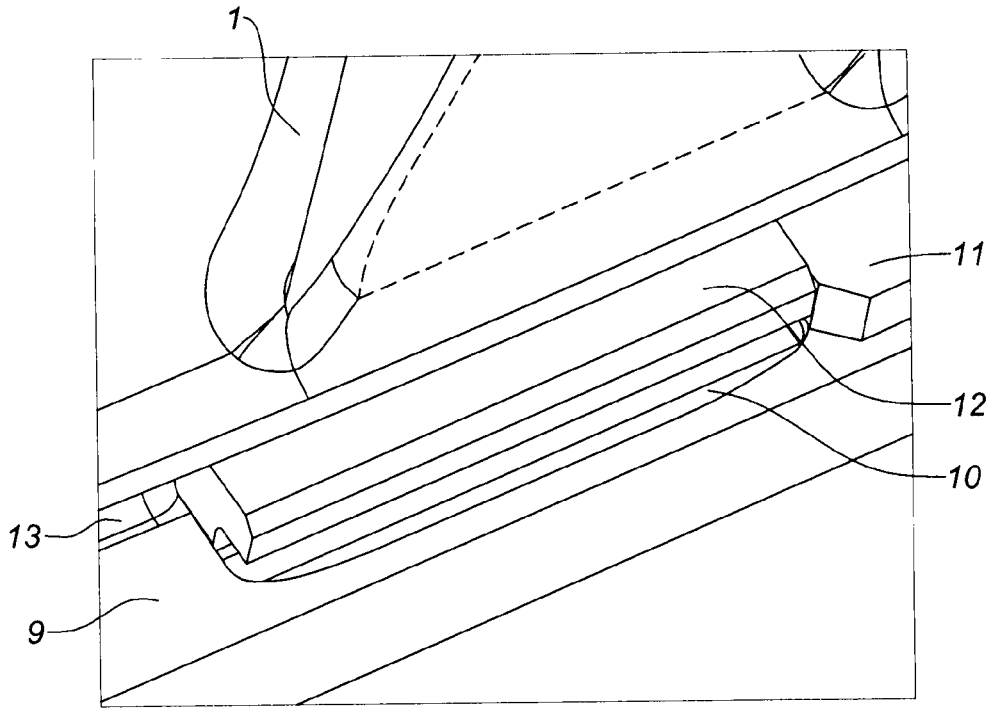
FIG. 4 is a view of a detail of FIG. 3.

FIGS. 3 and 4 show a shroud ring sector 4 in position on the downstream hook 8 of the casing 3. An LP guide vane blade sector 1 is also in position, the downstream end of its root 13 also being in contact with the support 9 of the shroud ring 4. The guide vane sector supports a second stop 12 which projects axially from the flank of the root 13 of the guide vane 1 to collaborate with the first stop 11 of the shroud ring sector 4. This second stop 12 passes through the recess 10 made in the support 9 in order to allow it to reach the first stop 11.

Figure 5:
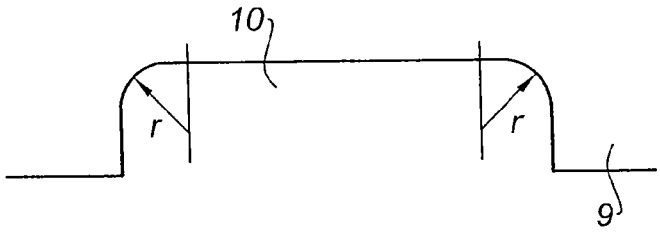
Fig. 5 PRIOR ART
FIG. 5 is a schematic view showing the shape of a turbine shroud ring recess according to the prior art.
Figure 6:
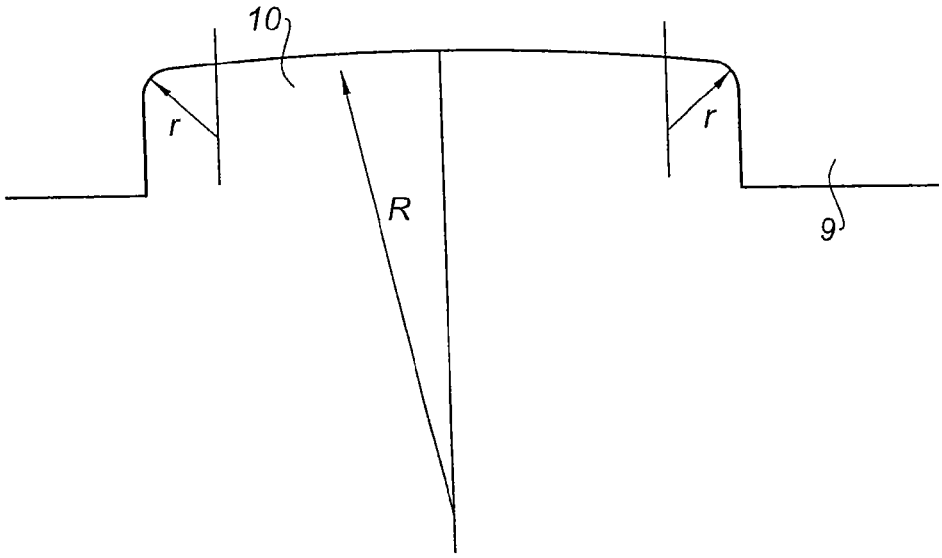
FIG. 6 is a schematic view showing the shape of a turbine shroud ring recess according to one embodiment of the invention.

Reference is made to FIGS. 5 and 6 which, in cross section, show the section of the recess 10 in two configurations. In the prior art depicted in FIG. 5, the recess 10 is in the shape of an open rectangle cut into the support 9, with the two corners of the bottom rounded at a relatively small radius of curvature denoted r; the bottom of the recess is straight.

In the embodiment of the invention as depicted in FIG. 6, the recess 10 is also substantially in the shape of a rectangle with the corners of the bottom rounded at the same small radius of curvature r. By contrast, the bottom of the recess is cut in a circular arc the radius of curvature R of which is very much greater than r, to give the recess the shape of a basket handle. The circular arcs of radius of curvature r and R lie in the continuation of one another, aligned along their common tangent.

Experiments conducted have demonstrated a very significant reduction in the level of stress, accompanied by the near-disappearance of cracks at the bottom of the recess once the ratio between the radii r and R reaches the value of 5. The improvement is even further enhanced if the radius of curvature R chosen for the bottom of the recess 10 is greater than the radius r it extends by a factor of at least ten. By contrast, this benefit begins to disappear if the ratio becomes higher still (for example of the order of 50).

Alternatively, the basket handle may be created by a succession of adjacent radii of curvature R1, R2, . . . , without being limited in number to two, so as to obtain the greatest possible reduction in the level of stresses observed at the bottom of the recess. This possibility of using, in series, a radius R1, greater than r, followed by a second radius R2 even greater than R1, is of use in creating a cutout which does not penetrate too deeply into the depth of the support 9; it thus becomes possible to keep the greatest possible thickness of metal in the support 9, at the bottom of the recess 10, while at the same time keeping the highest possible radius of curvature where the bottom of the recess meets the rounded corner.

In the extreme, it is possible to increase the number of radii of curvature indefinitely and thus arrive at a helix shape. The bottom of the recess then has the shape of two helixes each starting from one of the corners of the bottom of the rectangle extending the fillet of radius r, and which meet at the center of the bottom of the recess, the radius of curvature at this point being a radius R greater than r.

More generally, the bottom of the recess 10 has a convex shape, having a curvature that evolves between a radius of curvature r equal to that of the rounded corners, where it meets these rounded corners, and a radius R, greater than the radius r, at a point situated between the two rounded corners.

Although the invention has been described in conjunction with a number of specific embodiments, it is quite obvious that it is not in any way restricted thereto and that it comprises all technical equivalents of the means described and combinations thereof where these fall within the scope of the invention.

The invention claimed is:

1. A turbine shroud ring sector for a turbomachine supported at an upstream end by a downstream support of a turbine casing with circular sliding, comprising a stop able to collaborate with a second stop borne by an element of said turbomachine adjacent to said shroud ring in order to immobilize said shroud ring circularly, said turbine shroud ring sector comprising;

on an end facing said element, a recess able to allow said second stop to pass to come into contact with said first stop, said recess including first and second sides extending into said ring sector and a third side at a bottom of the recess connecting the first and second sides, the bottom of the recess having corners between the first and third sides and second and third sides that are rounded in a circular arc of radius r, wherein the third side at the bottom of the recess has a convex shape tangential to the circular arcs of the rounded corners and with a curvature that evolves between a radius of curvature r at a first point where the bottom of the recess connects with one of the rounded corners and a radius of R, greater than the radius r, at a second point situated between the two rounded corners.

2. The turbine shroud sector as claimed in claim 1, wherein the third side at the bottom of said recess has at least one circular arc portion of radius R.

3. The turbine shroud ring sector as claimed in claim 1, wherein the third side at the bottom of said recess has at least two circular arcs tangential to one another, with radii R1 and R2, both greater than r, R2 being greater than R1, and the circular arc of radius R1 being tangential to the circular arc of radius r of one of the rounded corners.

4. The turbine shroud ring sector as claimed in claim 1, wherein the third side at the bottom of said recess has a shape of two helixes each having a tangent in common with one of the circular arcs of the rounded corners, and the curvature of which varies continuously from the radius r to the radius R.

5. The turbine shroud ring sector as claimed in claim 1, wherein the radius R is greater than the radius r by a factor of at least 5.

6. The turbine shroud ring sector as claimed in claim 2, wherein the radius R is greater than the radius r by a factor of at least 5.

7. The turbine shroud ring sector as claimed in claim 3, wherein the radius R is greater than the radius r by a factor of at least 5.

8. The turbine shroud ring sector as claimed in claim 4, wherein the radius R is greater than the radius r by a factor of at least 5.

9. The turbine shroud ring sector as claimed in claim 1, wherein the radius R is greater than the radius r by a factor of at least 10.

10. The turbine shroud ring sector as claimed in claim 2, wherein the radius R is greater than the radius r by a factor of at least 10.

11. The turbine shroud ring sector as claimed in claim 3, wherein the radius R is greater than the radius r by a factor of at least 10.

12. The turbine shroud ring sector as claimed in claim 4, wherein the radius R is greater than the radius r by a factor of at least 10.

13. A turbine module for a turbomachine comprising at least one turbine ring shroud sector as claimed in one of the preceding claims.

14. A turbomachine comprising a turbine module as claimed in the preceding claim.

* * * * *

UNITED STATES PATENT AND TRADEMARK OFFICE

CERTIFICATE OF CORRECTION

PATENT NO. : 8,425,184 B2
APPLICATION NO. : 12/695664
DATED : April 23, 2013
INVENTOR(S) : Bruno Druez et al.

It is certified that error appears in the above-identified patent and that said Letters Patent is hereby corrected as shown below:

In the Claims:

Column 4, line 59, change "sides and second" to --sides and the second--.

Signed and Sealed this
Ninth Day of July, 2013

Teresa Stanek Rea
*Acting Director of the United States Patent and Trademark Office*